United States Patent [19]

Pohto et al.

[11] 4,108,752

[45] Aug. 22, 1978

[54] ELECTROLYTIC CELL BANK HAVING SPRING LOADED INTERCELL CONNECTORS

[75] Inventors: Gerald R. Pohto, Mentor; Michael Joseph Kubrin, Chardon, both of Ohio

[73] Assignee: Diamond Shamrock Corporation, Cleveland, Ohio

[21] Appl. No.: 801,552

[22] Filed: May 31, 1977

[51] Int. Cl.[2] ..... C25B 9/00

[52] U.S. Cl. ..... 204/256; 204/268

[58] Field of Search ..... 204/255, 256, 268, 269, 204/242, 254

[56] References Cited

U.S. PATENT DOCUMENTS

| | | | |
|---|---|---|---|
| 1,620,052 | 3/1927 | Allan | 204/259 |
| 1,815,079 | 7/1931 | Smith | 204/268 |
| 3,242,059 | 3/1966 | Cottam et al. | 204/98 |
| 3,453,587 | 7/1969 | Neidecker | 339/256 |
| 4,017,375 | 4/1977 | Pohto | 204/255 |

*Primary Examiner*—Charles F. Lefevour

*Attorney, Agent, or Firm*—Stephen A. Littlefield

[57] ABSTRACT

Disclosed is a spring-loaded electrolytic cell bank of modular construction in which a unitary anode and cathode cell is sandwiched with an identical cell and a multicontact, strip form conductor is interposed therebetween. The conductor establishes electrical connection betwen an anode of one cell and a cathode of the adjacent cell forming a bipolar series connection. The multi-contact conductive strips may be in the form of flat bars having louvers therein, an undulate strip or an askew helix which will contact the adjacent cell units at a plurality of contact points. The cell units and conductive strips are alternated in a filter press type cell bank for electrolytic processes such as the production of chlorine and caustic from the electrolysis of an aqueous brine.

12 Claims, 8 Drawing Figures

ELECTROLYTIC CELL BANK HAVING SPRING LOADED INTERCELL CONNECTORS

This invention relates generally to the art of electrolytic cells and more particularly to a cell bank comprised of a plurality of individual, self-contained cell units and means for electrically interconnecting same.

BACKGROUND OF THE INVENTION

The large volume production of chlorine and caustic (sodium hydroxide) needed to meet the demands of a modern society has led to the development and nearly exclusive use of electrolysis of aqueous solutions of sodium chloride to produce these essential materials.

Electrolytic cells of three general types are in general use. Initially, the so-called mercury cell was used in which a brine electrolyte was electrolyzed in a cell utilizing a liquid mercury cathode and an anode spaced from the surface thereof to produce chlorine gas and sodium-mercury amalgam. The product amalgam was then treated to remove the sodium as sodium hydroxide.

More recently, diaphragm cells have been developed, this type of cell now providing the majority of the production in chlorine and caustic.

A diaphragm-type electrolytic cell is comprised of a pair of electrode compartments which are separated by a diaphragm, usually made of asbestos or modified asbestos, one compartment containing an anode, the other a cathode. In applying the cell to use, brine (aqueous sodium chloride solution) is fed continuously into the anode compartment. Hydraulic pressure causes the brine to flow through the diaphragm to the cathode compartment. A flow rate of brine is maintained in excess of the conversion rate so that back migration of hydroxide ions is minimized. Chlorine gas is produced at the anode while hydrogen gas is evolved at the cathode, sodium ions combining with the hydroxyl group remaining after the electrolysis of water to form sodium hydroxide solution. Thus, the catholyte is a solution of sodium hydroxide and unconverted sodium chloride and other impurities which must be further processed to "pure" concentrated sodium hydroxide solution. Residual sodium chloride solution is returned to the cell for further processing.

Dimensionally stable anodes and various coating compositions therefor have permitted greater cell efficiencies since the anode-cathode gap may be narrowed significantly.

The use of the dimensionally stable anode with a substantially hydraulically impermeable ion-exchange membrane as an anode-cathode separator has the potential for even greater cell efficiency and substantially reduced production costs as compared with the use of a diaphragm separator.

Membrane cells permit only certain ions to migrate between the anolyte and catholyte. This results in a substantial improvement in the purity of the caustic catholyte since most metallic impurities and chlorine are retained in the anolyte. The post-electrolysis purification cost is thus substantially reduced. Furthermore, membrane cells produce a caustic of higher concentration than diaphragm cells thereby reducing or eliminating the cost of post-electrolysis concentration.

In order to increase the production and efficiency of electrolytic cells, filter press type structures have been proposed for the use of a plurality of cells connected in series or parallel to produce chlorine, alkali metal hydroxides and hydrogen.

In a bipolar filter press type structure, a plurality of cell units are connected in series in a filter press in which each electrode except those located at each end of the series acts as an anode on one side and a cathode on the other side. The space between adjacent bipolar electrodes is divided by a separator such as a diaphragm, modified diaphragm or membrane into anode and cathode compartments. Typically, an alkali metal halide solution is fed into the anode compartment where halogen gas is generated at the anode. Alkali metal ions migrate through the separator to the cathode compartment, there to form alkali metal hydroxide while hydrogen gas is liberated at the cathode. The product alkali metal hydroxide in the catholyte is then processed, as needed, to the desired purity.

A bipolar electrode is an electrode without direct metallic connection with a source of electric current, one face of which acts as an anode and the opposite face of which acts as a cathode when electric current is passed through the cell.

While the filter press-type electrolytic cell structure allows some economics of operation, the entire cell structure must be disassembled to remove and replace any faulty components of the structure. During this time, the entire cell is out of operation for the period of time required for maintenance and repair. The loss of operating time thus reduces the economy of operation gained by using such a structure.

The patent of Cottam, et al., U.S. Pat. No. 3,242,059 is illustrative of a filter press-type cell bank in which a plurality of anode-cathode pairs are located within a common enclosure, the electrodes being connected in series to form bipolar electrodes. The connection is effected by corrugated titanium sheets which also act to separate the electrolytes of adjacent cells. If any one component of this type of cell bank requires replacement, it is necessary to shut down the entire bank since it is an integral structure.

Various types of enclosed single-cell units connected in series have been proposed to alleviate the problem of complete shutdown and disassembly of a cell bank. However, the cell units are generally interconnected in series by a plurality of heavy external busbars whereby an anode of one cell is connected to the cathode of an adjacent cell. A connector of this type is described in Emery, et al., U.S. Pat. No. 3,565,783 issued Feb. 23, 1971. With the use of this type of external connector, there is still a considerable amount of production time lost in removing and reattaching the fasteners connecting the busbars to the cell units.

Another type of unitary cell is described in U.S. Pat. No. 4,017,375, issued Apr. 12, 1977, in which a plurality of cell units are welded together to provide a bipolar filter press cell bank. This structure incorporates conductive strips between two adjacent cell units which strips are welded to both cell units in order to establish electrical connection and provide cooling air space therebetween. The entire filter press structure is then encased in concrete to seal against corrosion and to provide a solid structure for absorbing the clamping stresses of a filter press type structure. As with other filter press structures, it is necessary to disassemble the entire cell bank in order to replace any one defective or worn component.

SUMMARY OF THE INVENTION

In accordance with the present invention, a removable electrolytic cell unit for a filter press electrolytic cell bank comprises a pair of matching pans, each having a dished recess and a peripheral flange surrounding the recess, the pans being connected together peripherally at the flanges so that the recess of each pan faces that of the connected pan. A generally planar separator is interposed therebetween. The recess of one pan and the corresponding planar side of the separator defines a first compartment and the other pan's recess and the opposite side of the separator defines a second compartment. A planar electrode is positioned within each compartment parallel to the plane of the separator and electrically and structurally connected to the corresponding pan. At least one access port is provided in each of the compartments for adding and removing solutions of brine and product material.

A filter press cell structure is built by aligning a plurality of the cell units of the type described so that the planar exterior surfaces of the pans are parallel. At least one multi-contact conductive strip is interposed between adjacent facing pan surfaces so that when the cell units are compressed together, the conductive strips are sandwiched therebetween to establish a positive electrical connection between adjoining cells at a plurality of points without the necessity of welds, heavy external connectors or fastening means. In this manner, an individual unit may be conveniently and quickly replaced by merely sliding out the old unit and sliding in an identical replacement unit.

Further in accordance with the invention, a conductive strip of the type described has a form which produces a spring-like force in the strip when it is compressed between the facing cell surfaces to further insure positive electrical connection between adjacent cells.

Further in accordance with the invention, the conductive strip of the type described may include a plurality of louvers spaced longitudinally on the strip, which louvers have edge portions which engage the cell surfaces to establish positive electrical connection therewith. A connector of this general type is described in Neidecker, U.S. Pat. No. 3,454,507 for other purposes.

Still further in accordance with the invention, a conductive strip of the type described has both an undulate form and a plurality of louvers spaced longitudinally along the strip, the louvers having edge portions which elastically deform so as to positively engage the surfaces of adjacent cell units and the undulate form providing additional spring action to assure positive electrical contact between the cells.

Further in accordance with the invention, electrolytic cell units are electrically connected in series in a cell bank by sandwiching at least one multi-contact strip of beryllium copper between the outer surfaces of adjacent cell units to form a filter press cell bank structure.

It is therefore a principal object of this invention to provide an electrolytic cell bank comprised of a plurality of individual cell units in which any one unit may be quickly and conveniently replaced by an identical cell unit without disrupting the operation of the remaining cells in the bank for any extended period of time.

It is a further object of this invention to eliminate heavy external electrical connectors or intercell welding from a filter press type electrolytic cell bank utilizing a plurality of individual cells.

It is yet another object of this invention to provide an elecrolytic cell bank which is inexpensive in terms of both initial cost of materials and installation and in maintenance cost.

These and other objects and advantages of the invention will appear to those skilled in the art through the reading and understanding of the following description of a preferred embodiment of the invention.

BRIEF DESCRIPTION OF THE DRAWINGS

A preferred embodiment of the invention is illustrated in the appended drawings forming a part of this specification and in which.

DETAILED DESCRIPTION OF THE PREFERRED EMBODIMENT AND DRAWINGS

Figure 1:
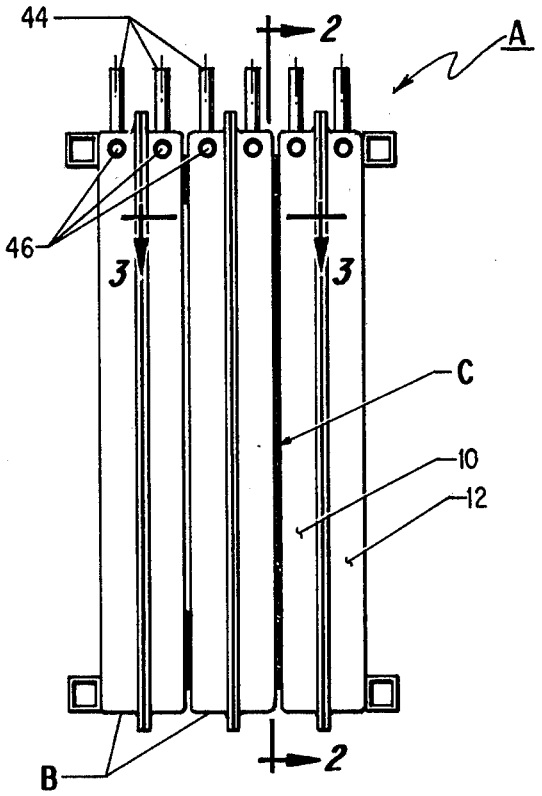
FIG. 1 is side elevational view of an electrolytic cell bank in accordance with the preferred embodiment of the invention.
Figure 2:
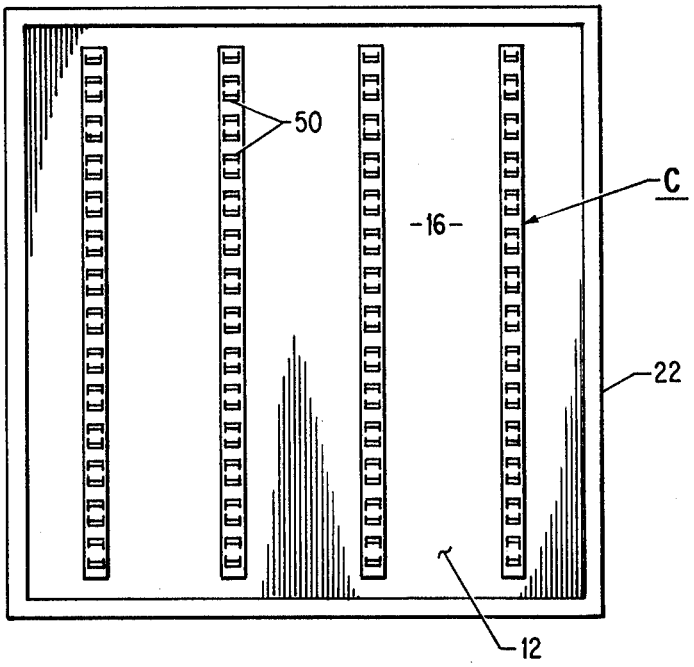
FIG. 2 is a cross-sectional view of the cell bank shown in FIG. 1 taken along line 2—2 thereof.
Figure 3:
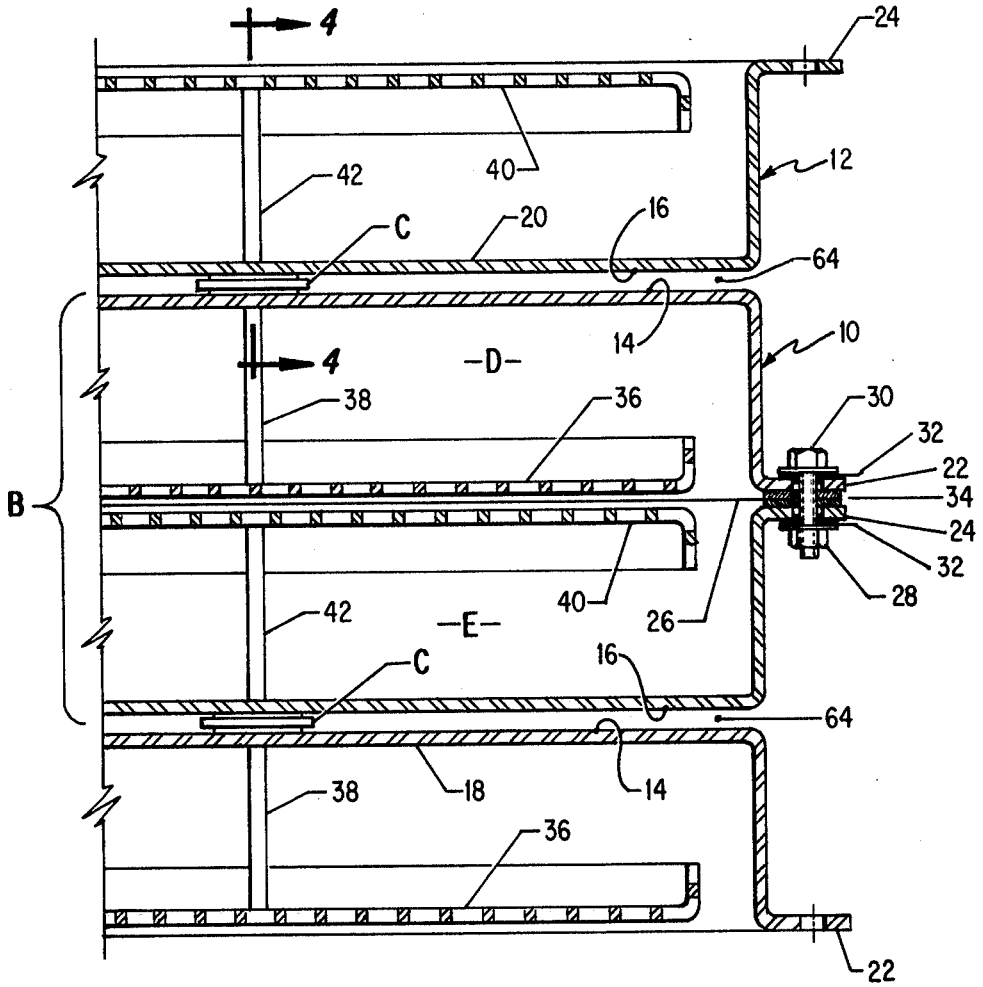
FIG. 3 is a cross-sectional view of the cell bank of FIG. 1 taken along line 3—3 thereof.
Figure 4:
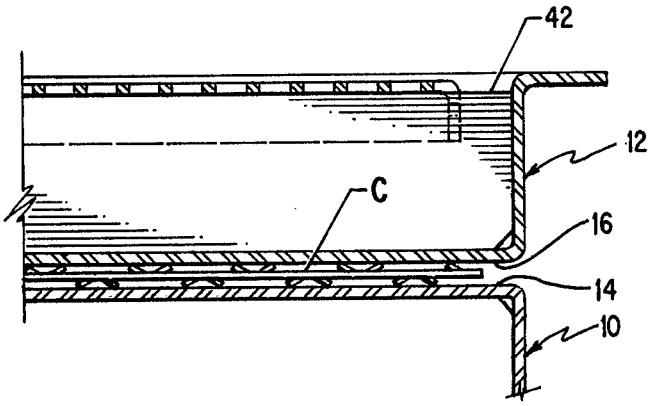
FIG. 4 is a cross-sectional view of the cell bank shown in FIG. 3 taken along line 4—4 thereof.

Referring now in greater detail to the drawings, an electrolytic cell bank A is generally depicted in FIG. 1 comprised of a plurality of individual cell units B which are electrically connected in series to form a bipolar cell bank by conductive strips C which are sandwiched between adjacent cell units B.

While it is to be understood that cell units B may be of any type such as mercury or diaphragm cells, the instant invention will be described in conjunction with a membrane cell for chlorine-caustic production. Such description should not be construed as a limitation upon the applicability of the invention to other types of cells or other electrolytic processes than those specifically mentioned, however.

An electrolytic cell unit B is comprised of a pair of identically shaped pans 10, 12 having outer planar surfaces 14 and 16, respectively. Recesses 18, 20 are formed in each pan 10, 12 each of the recesses being surrounded by peripheral flange 22, 24 which is generally parallel to outer planar surfaces 14, 16.

Pans 10, 12 are assembled to form cell units B so that their respective recesses 18, 20 are in a facing relationship and flanges 22, 24 are in an abutting relationship. A separator such as membrane 26 is interposed between flanges 22, 24 so that each pan 10, 12 and the membrane 26 define a compartment D, E, respectively, therewithin. Flanges 22, 24 are preferably fastened together with fastening means such as nut 28 and bolt 30, these means being insulated from flanges 22, 24 by insulating washers 32. Flanges 22, 24 are also insulated from each other preferably by an elastomer seal 34 around the outside of membrane 26 between the flanges 22, 24.

Disposed within compartment D is a planar anode 36, preferably of the dimensionally stable type made of titanium mesh which may or may not have an active coating thereon as desired. Anode 36 is parallel to and slightly spaced from planar membrane 26. At least one anode conductor bar 38 connects anode 36 to recess surface 18 of pan 10. Both anode conductor bar 38 and pan 10 are preferably made of titanium for reasons of corrosion resistance as will appear hereinafter. Anode conductor bar 38 performs a dual function in the present invention in that it also acts as a structural reinforcing element which allows a reduction in the thickness of the pan material resulting in a corresponding reduction in both cost and weight of the cell unit B.

Similarly, compartment E has a planar cathode 40 preferably made of steel mesh, cathode 40 being parallel to anode 36 and membrane 26 and slightly spaced therefrom. At least one cathode conductor bar 42 connects cathode 40 with recess surface 20 of pan 12. Pan 12 and cathode conductor bar 42 are preferably made of steel and, as with anode conductor bar 38, cathode conductor bar 42 acts to structurally reinforce pan 12 allowing a reduction in the overall cost and weight of the cell.

Pans 10, 12 are identical in form and thus may be formed on a single die thereby reducing the cost of tooling. Additionally, the welding connection of electrodes and conductor bars may be handled on automatic welding equipment thereby reducing the costs of fabrication.

Each compartment C, D has at least one access port such as feed lines 44 and/or outlets 46 opening into the compartments C, D for adding and/or removing fluid materials from same.

In the operation of this type of cell, a brine such as sodium chloride solution is fed into the anode compartment C, compartment D being filled with water or weak sodium hydroxide solution. By electrically connecting anode 36 and cathode 40 through conductor bars 38, 42 and pans 10, 12, respectively, to a suitable D.C. power source, chloride ions in the anolyte are oxidized at the anode 36 to form chlorine gas while sodium ions migrate through membrane 26 to cathode 40, there to form sodium hydroxide solution and evolve hydrogen gas at the cathode 40. Chlorine and hydrogen may be collected and sodium hydroxide pumped out as products of the electrolysis.

As is well known in the art, a bank of the abovedescribed cells may be constructed by connecting the anode of one cell to the cathode of an adjacent cell making a bipolar structure. Prior to this invention, such interconnection required a plurality of external conductor bars extending between adjacent cells and fastening means to connect the bars to the necessary points on each electrode or welding the cell units together in series.

The present invention utilizes only conductive strips C and compressive contact thereof between adjacent cell units B to establish electrical connection. As shown in detail in FIGS. 5–7, a conductive strip C may have a plurality of louvers 50 formed thereon.

Louvers 50 are formed by cutting a plurality of U-shaped slits transversely across the strip C and bending the flap portion of strip material intermediate adjacent pairs of slits outwardly so that louver edge portions 52 are exposed and located outwardly of the plane of the strip C. When sandwiched between a pair of adjacent pan faces 14, 16 louver edge portions 52 act with a resilient springing force to contact each face and establish an electrical connection therebetween so that the two pans 10, 12 form a bipolar electrode.

Figure 5:
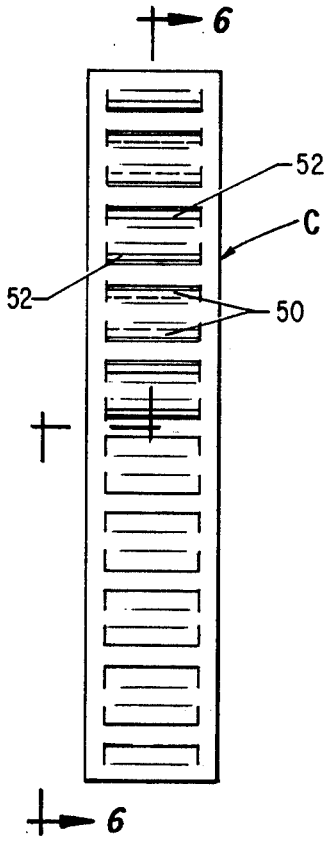
FIG. 5 is a plan view of a preferred form of conductive strip utilized in the invention.
Figure 6:
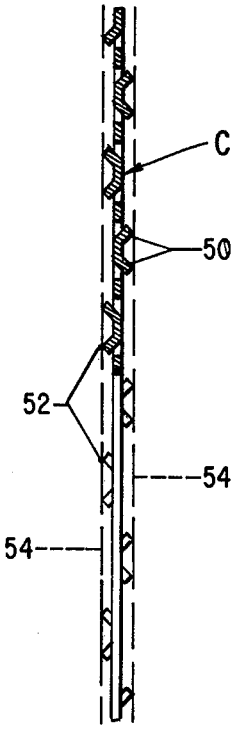
FIG. 6 is a side elevational view, in partial section, of the conductive strip shown in FIG. 5.
Figure 7:
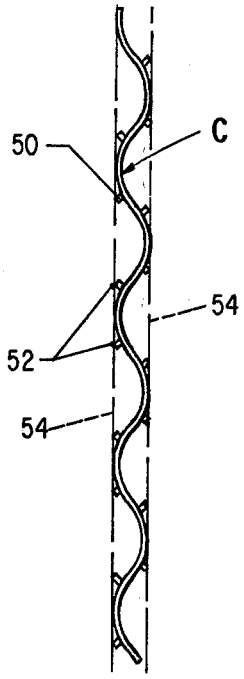
FIG. 7 is a side elevational view, in partial section, of another form of conductive strip in accordance with the invention.
Figure 8:
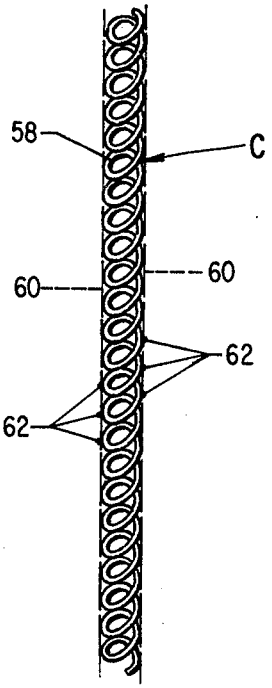
FIG. 8 is a side elevational view, in partial section, of another form of conductive strip in accordance with the invention.

Strips C may have any form, such as the linear form shown in FIGS. 5 and 6 when viewed in side elevation, or a form that is wavy or undulate such as shown in FIG. 7 of the askew helical form of FIG. 8.

A linear form conductive strip C is shown in FIGS. 5 and 6. A plurality of louvers 50 extend outwardly of the planar faces of the strip C in alternating pairs outwardly of one face or the other of the conductive strip. As can be seen from the illustration in FIG. 6, louvers 52 establish contact between parallel surfaces abutting thereto represented by dashed lines 54, which dashed lines may represent planar pans 10 and 12. In order to assure positive electrical connection, there is compressive contact of louver edge portions 52 with the adjacent abutting surfaces 54 so that an elastic bending or spring-like force is developed in louvers 50 to assure positive electrical connection.

By employing the undulate form of FIG. 7 the action of adjacent planes such as pans 10 and 12 in compressive contact against louver edge portions 52 causes and additional springing force to be realized over that provided by the bending flexure of louvers 50 alone, the additional springing force being provided by the undulate form. These two independently springing forces further assure positive electrical connection between the parallel facing surfaces 54.

An askew helical form may also be employed to establish electrical connection through a plurality of contacts such as is illustrated in FIG. 8. A helical spring, such as of beryllium copper, is formed having a helical axis passing therethrough. The laterally opposite sides of the helix are then forced in opposite directions parallel to the helical axis so that the helix is askew from its prior form. This askew form causes a spring force to be developed within the helix tending to return the helix to its original form because the helix has a smaller lateral width than that of its original form. With the interposition of an askew helic 58 such as shown in FIG. 8 between adjacent planar surfaces 60 a plurality of contacts 62 are made at the lateral edges of each loop of the helix. The normal springing force of the helix combined with the forces developed because of its askew configuration causes compressive contact between the contact points 62 and the parallel surfaces 60 to establish electrical connection between the parallel surfaces 60 at a plurality of points.

While conductive strips C may be merely placed between adjacent cell units B and compressed therebetween, it is preferred to secure the strips C to one of the pan faces 14 or 16 as by tack welding.

In practice, it is preferred that each pan incorporate a plurality of parallel anode or cathode conductor bars 38 or 42, respectively, to reinforce the pan structure. Conductive strips C are then preferably positioned on the pan faces 14, 16 along an external line corresponding to the internal position of conductor bars 38, 42 so that the additional rigidity of the structure at these points may be utilized.

Conductive strips C also perform an additional function in the structure in that they act to space adjacent pans from each other with an insulating air space 64. Air space 64 serves to reduce the temperature build-up between the cells due to electrical resistance.

Through the use of identical cell units B and conductive strips C, it can be clearly seen that replacement of defective or worn out cell bank components may be easily effected by merely withdrawing one cell unit and plugging in a new or remanufactured cell unit.

In order to reduce bimetallic interaction which may cause the corrosive breakdown of cell components, i.e. galvanic action between the titanium anode pans, copper conductive strips and/or steel cathode pans, air space 64 may be sealed with an appropriate barrier material to reduce the amount of fluids in this area of galvanic activity thereby extending the life of the components.

In order to further reduce galvanic corrosion of the bimetallic interconnection between the conductive strip and the anode and cathode pan, several other well known processes may be employed. One means for reducing the amount of corrosion would be to coat substantially the entirety of a conductive strip with a plastic material with the exception of the points of actual contact with the pan faces. Another means would be to coat all components with a common metal such as a maleable tin alloy case so that there is effectively no bimetallic galvanic site at which corrosion may occur. The use of a maleable coating would additionally provide the benefits of some deformation of the compressive contact points which would increase the contact area and thus lower the resistance of the interconnection. Other methods of preventing or reducing corrosion in such systems are well known to those skilled in the art and any of such means may be employed within the scope of the present invention.

While the invention has been described in the more limited aspects of a preferred embodiment, modifications of the basic concept have been suggested and still other modifications will occur to those skilled in the art upon the reading and understanding of the foregoing specification. It is intended that all such embodiments and modifications be included within the scope of this invention as defined only by the appended claims.

What is claimed is:

1. An electrolytic cell bank comprising:

a plurality of electrolytic cell units, each unit comprising an anode pan, a cathode pan, and a separator, said anode pan and separator enclosing an anode compartment having an anode and anolyte therewithin; said cathode pan and separator enclosing a cathode compartment having a cathode and catholyte therewithin; and at least one access port in each of said compartments for adding electrolyte and removing products therefrom, each of said compartments having an exterior face parallel to said separator and a plurality of conductive strips each having a plurality of louvers having edges thereon defining a plurality of contact points wherein at least one conductive strip is interposed between the exterior face of an anode pan of one cell unit and the adjacent exterior face of a cathode pan of an adjacent cell unit, said louvers being in compressive contact with said exterior faces of both said anode and cathode pans whereby an anode pan of one cell unit, each said conductive strip and a cathode pan of an adjacent cell unit form a bipolar electrode within said electrolytic cell bank.

2. The electrolytic cell bank as described in claim 1 wherein said conductive strip is rectangular in form and has an undulate configuration when viewed in side elevation and said contact points comprise edge portions of a plurality of louvers which extend outwardly from opposite faces of said rectangular conductive strip.

3. The electrolytic cell bank as described in claim 1 wherein said anode is connected to said anode pan by at least one anode conductor bar and said cathode is connected to said cathode pan by at least one cathode conductor bar and at least one conductive strip is located along said pans coextensive with said conductor bars.

4. The cell bank as described in claim 3 wherein each of said anode and cathode pans has a plurality of parallel anode and cathode conductor bars, respectively, and a plurality of said conductive strips are located along the exterior faces of said pans coextensive with said conductor bars.

5. The electrolytic cell bank as described in claim 1 wherein said separator is a hydraulically permeable diaphragm.

6. The electrolytic cell bank as described in claim 1 wherein said separator is a substantially hydraulically impermeable membrane.

7. The electrolytic cell bank as described in claim 1 wherein said conductive strip further acts as a separator between adjacent cell units so that there is an air space between said cell units.

8. The electrolytic cell bank as described in claim 7 wherein said air space has barrier material therewithin.

9. The electrolytic cell bank as described in claim 1 wherein said conductive strip is covered with a layer of protective, non-corrosive material, said contact points extending therethrough.

10. An electrolytic cell bank comprising:

a plurality of electrolytic cell units, each cell unit comprising an anode pan, a cathode pan, and a separator, said anode pan and separator enclosing an anode compartment having an anode and anolyte therewithin; said cathode pan and separator enclosing a cathode compartment having a cathode and catholyte therewithin; and at least one access port in each of said compartments for adding electrolyte and removing products therefrom, and a plurality of conductive strips each comprising an askew helix having a plurality of loops with laterally outward edges interposed between an anode pan of one cell unit and a cathode pan of an adjacent cell unit, said laterally outward edges of said helices being in compressive contact with both said anode and cathode pans whereby an anode pan of one cell unit, each said conductive strip and a cathode pan of an adjacent cell unit form a bipolar electrode within said electrolytic cell bank.

11. An electrolytic cell bank comprising:

a plurality of electrolytic cell units, each cell unit comprising an anode pan, a cathode pan, and a separator, said anode pan and separator enclosing an anode compartment having an anode and anolyte therewithin; said cathode pan and separator enclosing a cathode compartment having a cathode and catholyte therewithin; and at least one access port in each of said compartments for adding electrolyte and removing products therefrom, and a plurality of conductive strips each having a plurality of contact point thereon, each said conductive strip being a rectangular strip having a linear configuration when viewed in side elevation and said contact points being formed by a plurality of louvers extending outwardly from opposite sides of said rectangular strip, wherein at least one conductive strip is interposed between an anode pan of one cell unit and a cathode pan of an adjacent cell unit said anode pan, said cathode pan and said conductive strips having a common maleable metallic coating thereon.

12. The electrolytic cell bank as described in claim 11 wherein said maleable metallic coating is a tin alloy case.

* * * * *